US006305592B1

(12) United States Patent
Mann

(10) Patent No.: US 6,305,592 B1
(45) Date of Patent: Oct. 23, 2001

(54) DYE MACHINE FESTOONER

(75) Inventor: Michael G. Mann, Jacksons Gap, AL (US)

(73) Assignee: Russell Corporation, Alexander City, AL (US)

( * ) Notice: Subject to any disclaimer, the term of this patent is extended or adjusted under 35 U.S.C. 154(b) by 0 days.

(21) Appl. No.: 09/501,389

(22) Filed: Feb. 9, 2000

(51) Int. Cl.[7] ..... B65H 26/00; B65H 20/02; D06B 3/00

(52) U.S. Cl. ..... 226/45; 226/100; 226/187; 226/193; 68/178; 242/361.4

(58) Field of Search ..... 226/185, 187, 226/10, 45, 100, 193, 196.1; 242/361.4; 68/177, 178; 28/289; 19/160, 163

(56) References Cited

U.S. PATENT DOCUMENTS 1,768,414 * 6/1930 Lyth ..... 68/177
2,787,368 * 4/1957 Clark, Jr. et al. ..... 226/187 X
2,977,112 * 3/1961 Offner ..... 226/185
3,765,614 * 10/1973 Bartl et al. ..... 242/361.4
4,165,830 * 8/1979 Svendsen ..... 226/187
4,427,404 * 1/1984 Yamada ..... 19/160 X
5,483,730 * 1/1996 Hoover ..... 28/289
5,762,252 * 6/1998 Reitano ..... 226/45

* cited by examiner

*Primary Examiner*—Michael R. Mansen
(74) *Attorney, Agent, or Firm*—Robert J. Veal; Christopher A. Holland; Burr & Forman LLP

(57) ABSTRACT

A festooner transfers cloth between a dye machine and a transfer box utilizing a driven roller and a laterally mounted idler roller creating a vertical interstice to effect a vertical discharge of the cloth into a laying funnel. The driven roller is grooved to maintain tension on the cloth without creating adherence that would cause the cloth to wrap around the roller. A sensor further detects the presence or absence of driven roller, and reduces the speed of the driven roller when the idler roller is displaced from the driven roller.

11 Claims, 4 Drawing Sheets

27
18
29
17
16
26
27
11
21
13
17
16
21
35
34
32
41
31
33

DYE MACHINE FESTOONER

FIELD OF THE INVENTION

The present invention relates to the manufacture of died cloth and more particularly to the handling of such cloth between the dye machine and the wet box used for transporting such cloth. In greater particularity, the present invention relates to an apparatus for feeding the cloth to the dye wet box over a superajacent roller assembly. In still greater particularity, the present invention relates to the disposition of a driven and idler roller to maximize the throughput speed of fabric being so handled.

BACKGROUND OF THE INVENTION

Historically, wet dyed cloth in long strands was draped over a driver roller and passed from the dye kettle to a waiting box. The elongated cloth was allowed to pile into the bottom of the box and seek its own natural resting point; thus, when the cloth was later withdrawn from the box, it was often found to be looped or tangled about itself and thus required some time and effort to remove, deloop and untangle before it could be further processed. To solve this problem Russell Corporation developed a festooner arrangement which received the cloth between a pair of vertically aligned rollers, the bottom being a driven roller and the top an idler roller and fed the cloth to an oscillating funnel to distribute the cloth evenly in the box. The rollers were able to handle cloth rapidly; however, the festooner assembly fed cloth to the funnel faster than the cloth could drop under the influence of gravity; therefore, although the problem of piling into the bottom of the carriage was substantially eliminated, additional problems were encountered. As the cloth passed through the rollers it was rapidly expelled against a baffle such that it would be deflected into the waiting funnel, for transfer into the box. Since the cloth could be expelled faster than it could fall, it would tend to bunch at the baffle and downstream of the rollers. In normal circumstances and during bunching conditions, the cloth has a tendency to cling to the driven roller, resulting in occasional wrapping of the cloth about the rotor. It has been estimated that such an event, which requires stoppage of the equipment for the time needed to clear the roller and possibly cut out any cloth damaged by the wrap, happened two or three times an hour. Further, the faster the rollers went, the more likely a wrap would occur. Therefore, the speed of the transport apparatus was limited by the speed at which the material would fall. Since removal of the cloth from the dye machines is a necessary function, it became clear that the existing situation created a bottleneck, resulting in idle time for the dyeing machinery while unloading transpires or the downstream processing machinery may be waiting on cloth to be delivered. In either event the prior festooner assembly needed improvement to optimize the process throughput. Further, it should be understood that the existing systems used a metal funnel below the driven roller to oscillate as the cloth passed therethrough to attempt to lay the cloth in a regular pattern and reduce coiling and tangling. As the festooner was moved from dye machine to dye machine, the lower end of the funnel would be susceptible to damage from collisions with other machinery. The metallic funnel would be deformed and could become unusable if the deformation were extensive or likely to damage the cloth as it passes through the funnel. Also forces on the rigid funnels are transmitted readily to the festooning mechanism causing serious machine damage.

From the forgoing it may be seen that the existing festooner assemblies known to the inventor required improvement to reduce the downtime, to increase the productivity, and to provide less wasted product and equipment damage.

SUMMARY OF THE INVENTION

It is an object of the present invention to increase the throughput speed of cloth moving from a dye machine to a transfer box.

Another object of the invention is to reduce the amount of cloth damaged by improper handling of the cloth as it is removed from the dye machine.

Still another object of the invention is to optimize plant operations by increasing the availability of a festooner assembly for servicing a plurality of dye machines.

A further object of the invention is to reduce the risk of damage to the festooner assembly by making the lower end thereof resilient.

These and other objects and advantages of my invention are accomplished by the beneficial combination of several elements of the invention in a novel and unobvious manner. Specifically, the problem of cloth wrapping about a driven roller and a relatively low speed of operation, created a catch 22 situation, to wit, to increase the speed of the rollers increased the potential for wrapping, which reduced overall speed and caused delays, whereas operating the festooner at reduced speeds reduced the potential for wrapping but reduced overall speed below acceptable levels. Intuitively, the problem appeared to be solvable by minimizing the contact between the driven roller and the cloth; thus, if the cloth could be kept from draping about a large arch of the roller it would be less likely to wrap, thus creating a pinch point at the top of the roller and expelling the cloth against the baffle provided the minimum carry of the cloth by the driven roller. However, the gravitational limitation caused efforts toward optimization in this direction to be fruitless.

When it was determined that the gravitational acceleration of the cloth was the limiting factor in throughput and that consequential downstream sag caused the cloth to wrap, the present invention was proposed to generate a downward expulsion of the cloth from between the rollers. However, this entailed allowing the cloth to be carried by the driven roller, which was a smooth surfaced roller, for more than ninety degrees, thus causing significant concern with cloth adhering to the roller and wrapping after the cloth is discharged from between the rollers. In the present invention the smooth surfaced roller of the prior system was replaced by a grooved roller, thereby providing less surface area for adherence between the carried cloth and the roller and allowing air to enter between the two. As a result of the horizontal displacement of the idler roller, the throughput speed has essentially doubled and, cloth wraps have been virtually eliminated.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENT

Figure 1:
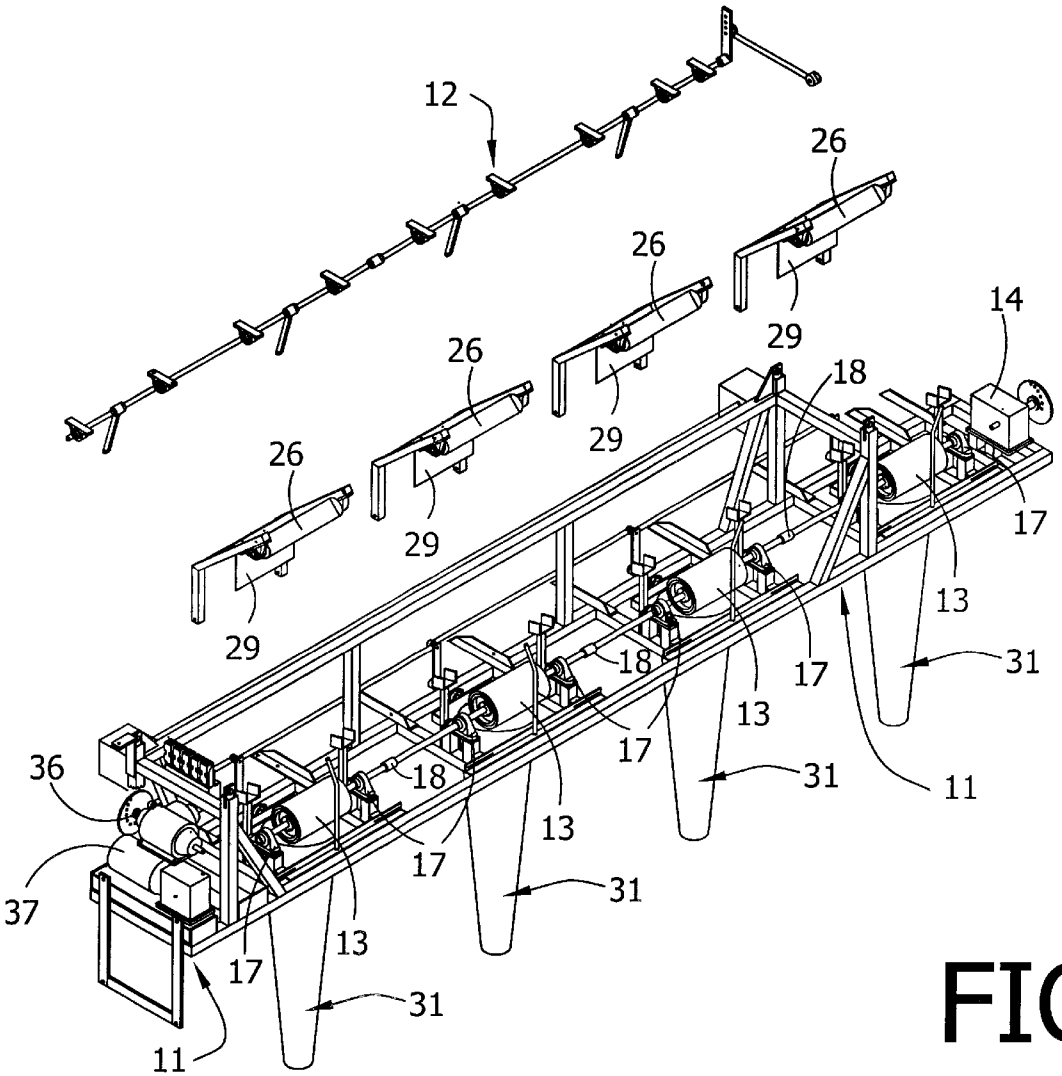
FIG. 1 is an exploded view of a festooner assembly capable of servicing four dye machines at one time.

Referring to the drawings for a clearer understanding of the invention, it will be noted in FIG. 1 that a plurality of dye machines may be simultaneously serviced by a single festooner assembly mounted on an overhead rail. The assembly may be moved throughout the dye house to service multiple dye machines in the dye house. The festooner assembly includes a main frame 11 that supports the majority of the remaining components and serves to attach the assembly to an overhead rail conveyor system 12. In practice the festooner assembly may have any practical number of driven rollers 13 ganged together and driven by a single motor 14; however, the usual number of driven rollers will typically vary from two to four. Frame 11 is made of stainless steel to reduce corrosion. Each roller 13 is carried on a drive shaft 16, mounted in noncorrosive bearing blocks 17, typically made from a thermoplastic composite material, which are affixed to frame 11. Each drive shaft 13 may be connected by a splint 18 to each adjacent drive shaft 13 such that a single drive motor 14 can drive all of the rollers 13.

Figure 2:
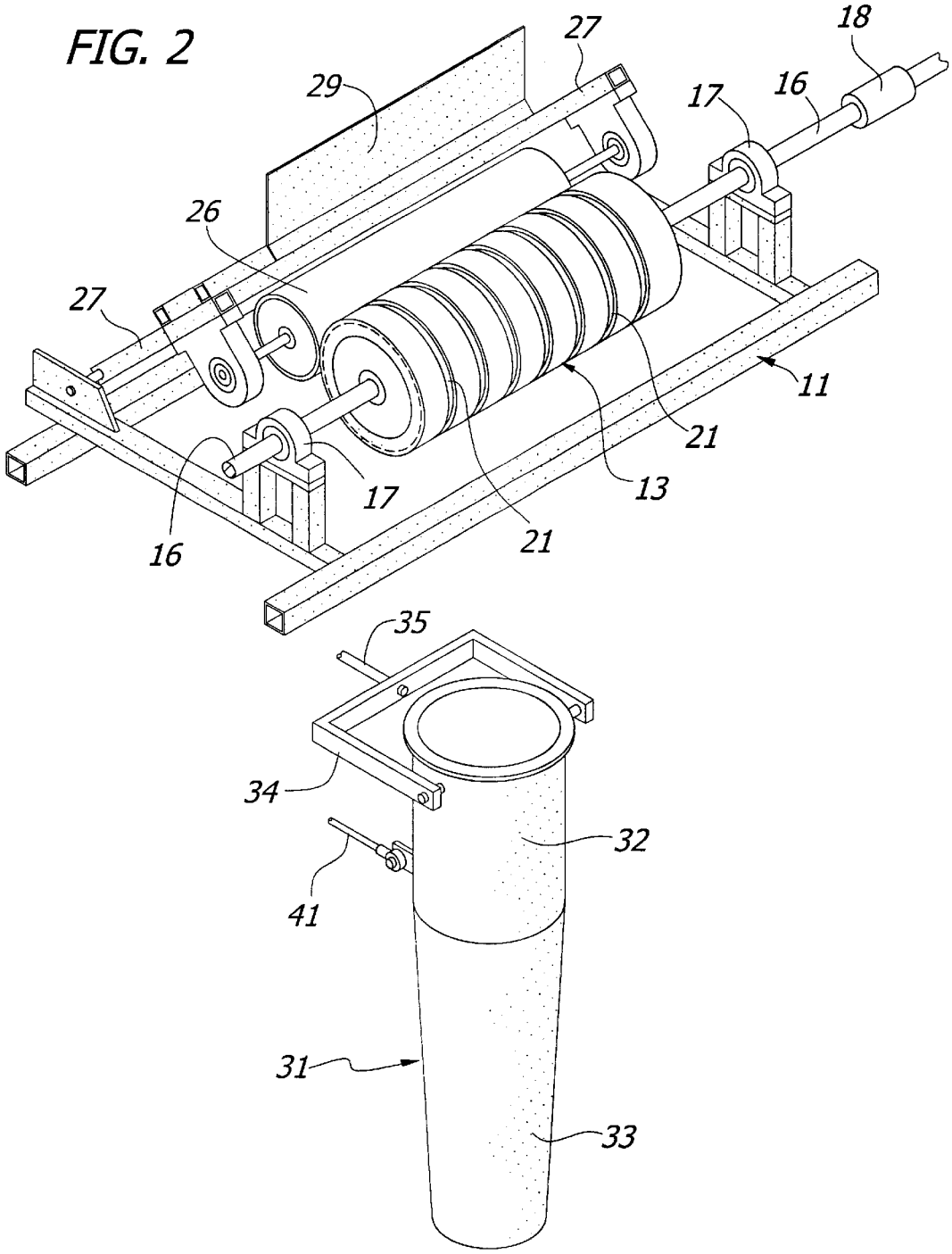
FIG. 2 is a perspective view of a driven roller and idler roller in cooperative relation in the present invention.
Figure 3:
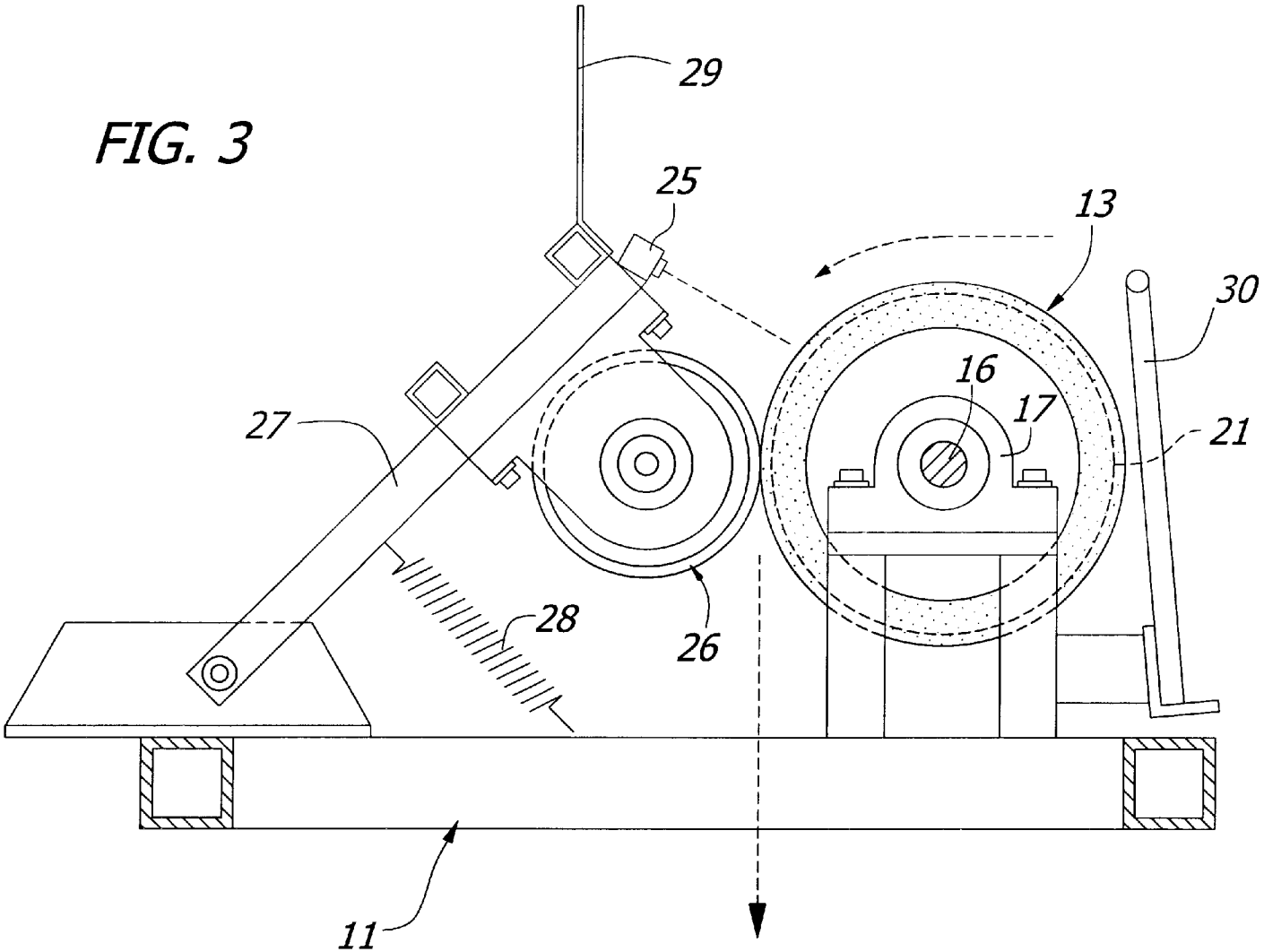
FIG. 3 is a side elevational view of the driven roller and idler roller in cooperative relation in the present invention.

Referring to FIGS. 2 and 3, rollers 13 differ from previously used rollers in that they are made from a suitable polyurethane material and have a plurality of grooves 21 formed circumferentially about the roller 13 and spaced axially along the roller 13. For example, a sixteen-inch long roller 13 having a twelve-inch diameter may have seven grooves 21 equally spaced along the roller 13, each groove 21 being one-half inch wide and one-half inch deep. An idler roller 26 is mounted cooperatively with each driven roller 13. Each idler roller 26 is mounted on a pivotal or otherwise movable idler subframe 27, which supports the idler roller 26 paraxially with driven roller 13 along side driven roller 13. A spring 28, or other biasing means such as a fluid or air actuated cylinder, may be employed to maintain idler roller 26 against driven roller 13. The interstice between idler roller 26 and driven roller 13 creates a pinch region in which a length of cloth is gripped to pull the cloth from the dye-machine and discharge it into the conveying box. Idler frame 27 also carries a sensor 25 that detects the presence or absence of driven roller 13. Thus, if idler frame 27 is displaced too far from roller 13, an alarm sounds and the machine is turned off. Accordingly, if a wrap occurs and causes build up of material on the driven roller 13, idler frame 27 and idler roller 26 will be displaced enough to initiate an alarm sequence for idler frame 27 and idler roller 26. Disposed above idler roller 26 on idler frame 27 is a plate 29 that serves to deflect the end of the cloth toward the driven rollers 13 during a start up of the driven rollers 13. A U-shaped guide 30 is removably affixed to frame 11 in front of driven roller 13 to guide the cloth as festooning assembly is pulling it.

Figure 4:
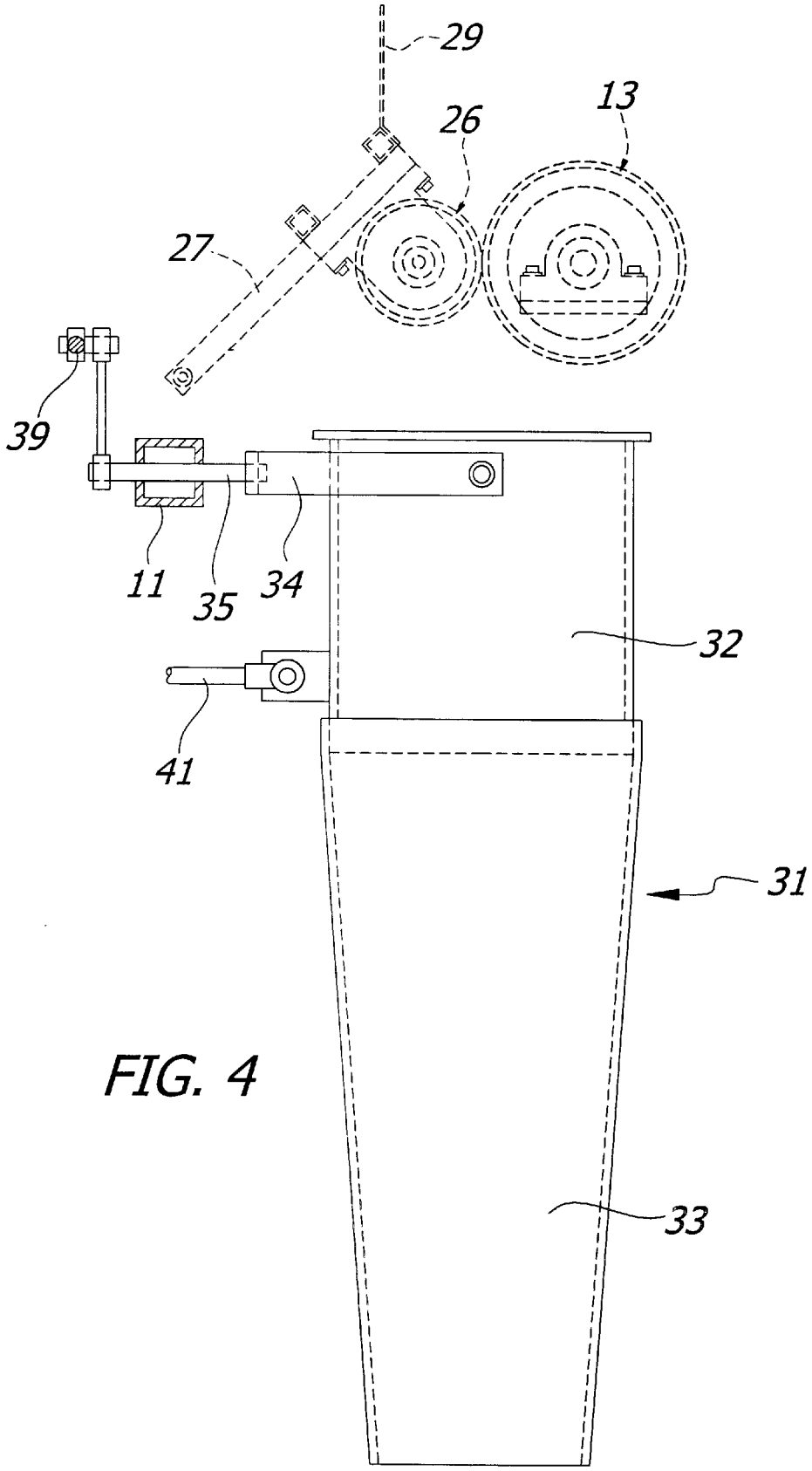
FIG. 4 is a side elevational view of the improved funnel of the present invention.

Referring to FIG. 4, mounted beneath the driven and idler rollers 13, 26 and vertically aligned with the interstice therebetween is a funnel 31 that in the present invention includes an upper metallic portion 32 and a lower plastic portion 33. The upper portion is mounted to a yoke 34 by pivot pins that allow pivotal movement between the arms of yoke 34. Yoke 34 itself includes a mounting shaft 35 that is pivotally mounted such that the yoke may pivot about an axis centered between and parallel to the yoke arms. Thus funnel 31 may pivot horizontally and longitudinally beneath the roller assembly. Frame 11 carries two drive motors 36 and 37 which carry cam wheels attached by appropriate linkages 38 to rocker shafts 39 and 41 which are connected to yoke shaft 35 and upper portion 32 to create oscillating movement to discharge the cloth into the box in a controlled pattern to prevent tangling.

In operation, the festooner assembly will be positioned adjacent a plurality of dye machines and superjacent a plurality of conveying boxes (not illustrated). An operator will locate the end of a cloth strand and toss it over driven roller 13 within guide 30 such that the end is received in the interstice between the driven and idler rollers 13, 26, whereupon the cloth will be pulled from the machine and discharged through the funnel 31 in a layered pattern in the conveying box. After the passage of time, driven roller 13 may begin to wear, whereupon guide 30 may be detached and moved axially along the driven roller 13 to guide the cloth over a different portion of the driven roller 13 thereby providing a positive grip on the cloth and increasing the useful life of the driven roller 13.

While I have shown the invention in a single form it is to be understood that the invention is not so limited but rather is to be defined by the full scope of the claims appended hereto.

What I claim is:

1. In an apparatus for transferring dyed fabric from a dye machine to a dye box, wherein the fabric is comprised of an elongated strand, the improvement comprising:

a. a driven roller mounted for rotation about a horizontal axis above the dye box and having a plurality of axially spaced annular grooves;

b. an idler roller mounted for rotation about a horizontal axis above the dye box and urged against said driven roller in substantially horizontal relation defining a vertical interstice therebetween, wherein said idler roller is mounted on a pivotal frame for movement toward and away from said driven roller;

c. a funnel mounted beneath said interstice between said driven roller and said idler roller for receiving the strand of fabric passing through said rollers; and d. a sensor for detecting the spacing between said idler roller and said driven roller, said sensor including an output in accordance with said spacing.

2. The improvement as defined in claim 1 wherein said driven roller is driven by a controllable motor and operably connected to said sensor such that an output from said sensor is utilized to stop said motor upon excess spacing being sensed.

3. The improvement as defined in claim 1 wherein said driven roller has a plurality of circumferential grooves formed therein.

4. An apparatus for transferring dyed fabric from a dye machine to a dye box, wherein the fabric is comprised of an elongated strand, comprising:

a driven roller mounted for rotation about a horizontal axis above the dye box and having a plurality of axially spaced annular grooves;

an idler roller mounted for rotation about a horizontal axis above the dye box and urged against said driven roller in substantially horizontal relation defining a vertical interstice therebetween, wherein said idler roller is biased against said driven roller defining a pinch point along said interstice for receiving the strand of fabric and urging it between said driven roller and said idler roller;

a funnel mounted beneath said interstice between said driven roller and said idler roller for receiving the strand of fabric passing between said driven roller and said idler roller; and a frame supporting said idler roller for transverse movement toward and away from said driven roller, said frame supporting an upstanding deflector plate above said idler roller.

5. An apparatus for transferring dyed fabric from a dye machine to a dye box, wherein the fabric is comprised of an elongated strand, comprising:

a driven roller mounted for rotation about a horizontal axis above the dye box and having a plurality of axially spaced annular grooves;

an idler roller mounted for rotation about a horizontal axis above the dye box and urged against said driven roller in substantially horizontal relation defining a vertical interstice therebetween, wherein said idler roller is biased against said driven roller defining a pinch point along said interstice for receiving the strand of fabric and urging the strand between said driven roller and said idler roller;

a funnel mounted beneath said interstice between said driven roller and said idler roller for receiving the strand of fabric passing between said driven roller and said idler roller, wherein said funnel comprises an upper metallic portion and a lower plastic portion connected to and supported by said metallic portion.

6. A roller assembly for use in removing wet cloth strands from a dye machine comprising a driven roller, means for rotating said driven roller, an idler roller mounted for pivotal motion toward and away form said driven roller defining a vertically oriented interstice between said driven roller and said idler roller for receiving the cloth strands in said interstice, and a monitoring sensor connected to said means for rotating said driven roller, said sensor controlling said means for rotating said driven roller according to the width of said interstice.

7. The assembly as defined in claim 6 wherein said idler roller is biased against said driven roller defining a pinch point along said interstice for receiving said strand of cloth and urging it through said rollers.

8. The assembly as defined in claim 6 wherein said driven roller is driven by a controllable motor and operably connected to said sensor such that an output from said sensor is utilized to stop said motor upon excess spacing being sensed.

9. The assembly as defined in claim 6 further comprising a frame supporting said idler roller for transverse movement toward and away from said driven roller, said frame supporting an upstanding deflector plate above said idler roller.

10. The assembly as defined in claim 6 further comprising a funnel having an upper metallic portion and a lower plastic portion connected to and supported by said metallic portion, said funnel being pivotally mounted beneath said interstice.

11. An assembly for concomitantly transferring multiple strands of dyed fabric from a dye machine to a dye box, the assembly comprising:

a support frame;

a plurality of drive shafts rotatably mounted to said support frame, each said drive shaft supporting a driven roller and rotating said driven roller about a horizontal axis above the dye box;

a plurality of idler rollers pivotally mounted to said frame, each said idler roller rotating about a horizontal axis above the dye box, wherein each said idler roller is controllably urged against a corresponding said driven roller in substantially horizontal relation and defining a vertical interstice therebetween, wherein the speed of rotation of each said drive shaft is governed according to the size of said interstice; and a plurality of funnels, each said funnel being mounted below one said interstice between one said driven roller and one said idler roller, each said funnel receiving one strand of fabric passing between said corresponding driven roller and said corresponding idler roller.

* * * * *